US007690307B2

(12) United States Patent
Gonzalez

(10) Patent No.: US 7,690,307 B2
(45) Date of Patent: Apr. 6, 2010

(54) MECHANICAL STEMMING APPARATUS FOR MINING BLASTING OPERATIONS

(75) Inventor: Gonzalez Luis German Gonzalez, Antofagasta (CL)

(73) Assignees: Luis Germán González González, Antofagasta (CL); Cauchos Industriales S.A., Santiago (CL)

( * ) Notice: Subject to any disclaimer, the term of this patent is extended or adjusted under 35 U.S.C. 154(b) by 0 days.

(21) Appl. No.: 12/059,734

(22) Filed: Mar. 31, 2008

(65) Prior Publication Data

US 2008/0236434 A1 Oct. 2, 2008

(30) Foreign Application Priority Data

Mar. 29, 2007 (CL) ..... 870-2007

(51) Int. Cl.
*F42D 1/18* (2006.01)
*E21B 33/12* (2006.01)

(52) U.S. Cl. ..... 102/333; 166/135

(58) Field of Classification Search ..... 102/313, 102/333; 166/135, 192, 196, 203
See application file for complete search history.

(56) References Cited

U.S. PATENT DOCUMENTS

| | | | | | |
|---|---|---|---|---|---|
| 8,011 | A | * | 4/1851 | Monson | 102/333 |
| 85,888 | A | * | 1/1869 | Ball | 102/333 |
| 137,196 | A | * | 3/1873 | Gotham | 102/333 |
| 615,321 | A | * | 12/1898 | Straub et al. | 166/214 |
| 1,507,983 | A | * | 9/1924 | Anderson | 166/192 |
| 1,921,229 | A | * | 8/1933 | Hodge | 102/328 |
| 2,257,063 | A | * | 9/1941 | Mossman et al. | 102/333 |
| 2,536,431 | A | * | 1/1951 | Endsley | 138/89 |
| 2,835,197 | A | * | 5/1958 | Ferguson | 102/301 |
| 3,756,316 | A | * | 9/1973 | Van Ruth | 166/132 |
| 4,787,315 | A | * | 11/1988 | Kenny | 102/313 |
| 4,848,734 | A | * | 7/1989 | Ford | 254/134.4 |

* cited by examiner

*Primary Examiner*—Bret Hayes
(74) *Attorney, Agent, or Firm*—Husch Blackwell Sanders Welsh & Katz

(57) ABSTRACT

An apparatus to mechanically stem (plug) a borehole or blast hole to contain or confine the gases generated by explosives is provided, thus preventing the energy generated by explosives to be released to the atmosphere. An assembly of the mechanical stemming apparatus for mining blasting operations according to the present invention comprises 2 pieces, placed one over the other: a base piece (1) and a central piece (6), and additionally includes two lateral wedge pieces (8) and four supporting pivots (11). The mechanical stemming apparatus according to the present invention and the entire apparatus set form a cylindrical body with a diameter lower than the borehole diameter and a length directly proportional to the diameter and depth of the boreholes or blast holes.

13 Claims, 5 Drawing Sheets

MECHANICAL STEMMING APPARATUS FOR MINING BLASTING OPERATIONS

FIELD OF THE INVENTION

This invention discloses an apparatus to mechanically stem (plug) a borehole or blast hole to contain or confine the gases generated by explosives, thus preventing the energy generated by explosives to be released to the atmosphere.

BACKGROUND OF THE INVENTION

Blasting is one of the most relevant processes in mining extraction and its main goal is fragmenting rocks, both ores and sterile material, by using explosives. This is done according to established safety regulations, operational procedures and techniques that allow performing all the size-reduction process in a safe and efficient way. In the rock blasting process to fragment the rock, it is necessary to cause contention or confinement of the energy generated by explosives, which cause rock breakage and fragmentation by expanding them. Therefore, the structural strength of the rock has to be surpassed to cause rock displacement.

Currently, mining industry uses soil or ground material or the same cuttings or detritus material (material that remains around each borehole or blast hole due to perforation), which is used as a plug to stem boreholes or blast holes with the aim of confining the explosive charge. Mini-loaders or bobcats are used to stem boreholes or blast holes, and human labor is used when boreholes or blast holes cannot be machine-stemmed, which is the case when equipment cannot access sectors with reduced space. This work is done by using bronze shovels, and the personnel must be careful to select the abovementioned material with no boulders (larger volume rocks), in order to avoid cutting the descending electric lines. Likewise, they have to take into account the safety regulations for said labors. These operational systems are, in short, inefficient and slow, which causes damage in terms of time and a higher operational cost in the system. Likewise, is any borehole or blast hole does not have detritus material to be used for stemming, the operator has to move remnant material from other previously covered boreholes or blast holes, taking the precaution of not damaging electric line in said boreholes or blast holes, by selecting the material and assuring that no larger boulders are present. These actions require more operators and helpers. These personnel must take a stable and safe position, i.e. facing the equipment in such a way as to keep total vision of the operation. Moreover, they must have complete communication with the operator to signal the steps to follow. However, the abovementioned plug material does not serve the purpose of confining the explosive column, because it is completely lose inside the borehole or blast hole and does not oppose the explosive energy once the detonation is activated. As a result, said material, together with the explosive energy, is expelled to the atmosphere, due to a lack of confinement inside the blast hole because it does not have any suitable anchoring system to the borehole or blast hole.

In a blast operation, it is possible to observe that a given percentage of explosive energy is released to the atmosphere. Likewise, the rock fragmentation effectiveness is relative, because the shock waves generated by the explosives have an intensity lower than expected, and so not enough energy propagation is obtained in the blast operation.

A relevant issue in the general extractive industry is related to rock fragmentation, since current techniques do not assure a good fragmentation quality, due to energy losses produced by an inadequate confinement of the gases generated by explosives. Other factors that have a considerable influence in operational and economic terms are, for instance: high explosive, man-hours, and machine-hours requirements, higher wear or lower useful life for machines, equipments and accessories. These reasons make desirable to decrease operational costs and increase the useful life of machines, equipments and accessories.

To optimize the current blasting system, it is desirable to have a stemming apparatus that allows containing or confining the energy generated by explosives and using said energy to fragment rocks, thus allowing other operational technical aspects such as lower costs and productivity increase in great mining.

STATE OF THE ART

Currently, in a constant search for a material or product to be used as explosive-energy-retaining plug, mining companies have employed fine gravel material, which causes operational difficulties such as gravel transportation from and inside the mine, increase of the time used for borehole or blast hole stemming and supply problems, and these materials do not yield significant improvements.

Another example is the use of plugs known as "Chinese hats", which are conical devices destined to seal the collar or opening of the borehole or blast hole, in order to confine the energy generated by explosives. This device has a bolt and nut which expand the cone causing this to exert pressure against the blast hole walls when these elements are manually tightened, and, once the detonation has taken place, the device is expelled to the atmosphere, thus not achieving the desired purpose.

Likewise, wet clay, air bags, epoxy resins, burnt intern-combustion-motor oil have been used, among many other systems, which have not served their purpose efficiently.

Currently, many patent applications try to solve one of the technical problems solved by the present invention, i.e. optimal confinement of gases inside boreholes or blast holes. For example, Patent Application WO 02/090873 describes a divided plugging bar that comprises a first and a second wedge piece; Patent Application U.S. Pat. No. 5,936,187 describes a borehole plug made of a durable, elastic and strong material, or Patent Application U.S. Pat. No. 5,247,886 describes a borehole plug that comprises a wedge piece and a stabilizing structure in the wedge piece.

Some of the advantages of the present invention in comparison with the abovementioned patents are:

a. soil or ground material or detritus does not serve plug functions, and only a minimal amount is used as isolating material between the explosive column and the mechanical stemming device, with the purpose of avoiding direct contact with high temperatures generated by explosive in the moment of blasting;
b. mini-loader, bobcat and personnel use are dispensed for boreholes or blast holes that are difficult to be stemmed by using machines; and
c. the possibility of cutting descending electric lines that connect detonators is reduced.

DETAILED DESCRIPTION OF THE INVENTION

This invention has the objective of solving a big optimization necessity in blasting processes. This is done by using a mechanical stemming apparatus for mining blasting operations, the main object of which is containing or confining the gases generated by explosives, preventing the energy generated by said explosives to be released to the atmosphere and consequently optimizing blasting processes by incorporating novel benefits into the mining industry.

By using said mechanical stemming apparatus, a higher value will be created in mining blasting processes, in operational, cost and productivity terms in relation with the current state of the art.

The mechanical stemming apparatus of the present invention is made by polymers in general and polymer mixtures, such as: mixtures of polymers with siliceous sands, aluminosilicates, chromite, magnesia, quartz, zircon, refractory synthetic sands, and other sands, and also concretes and refractory mortars in general, as well as mixtures with refractory cements, Portland cement, alternative cements, biocements, etc.

Figure 1:
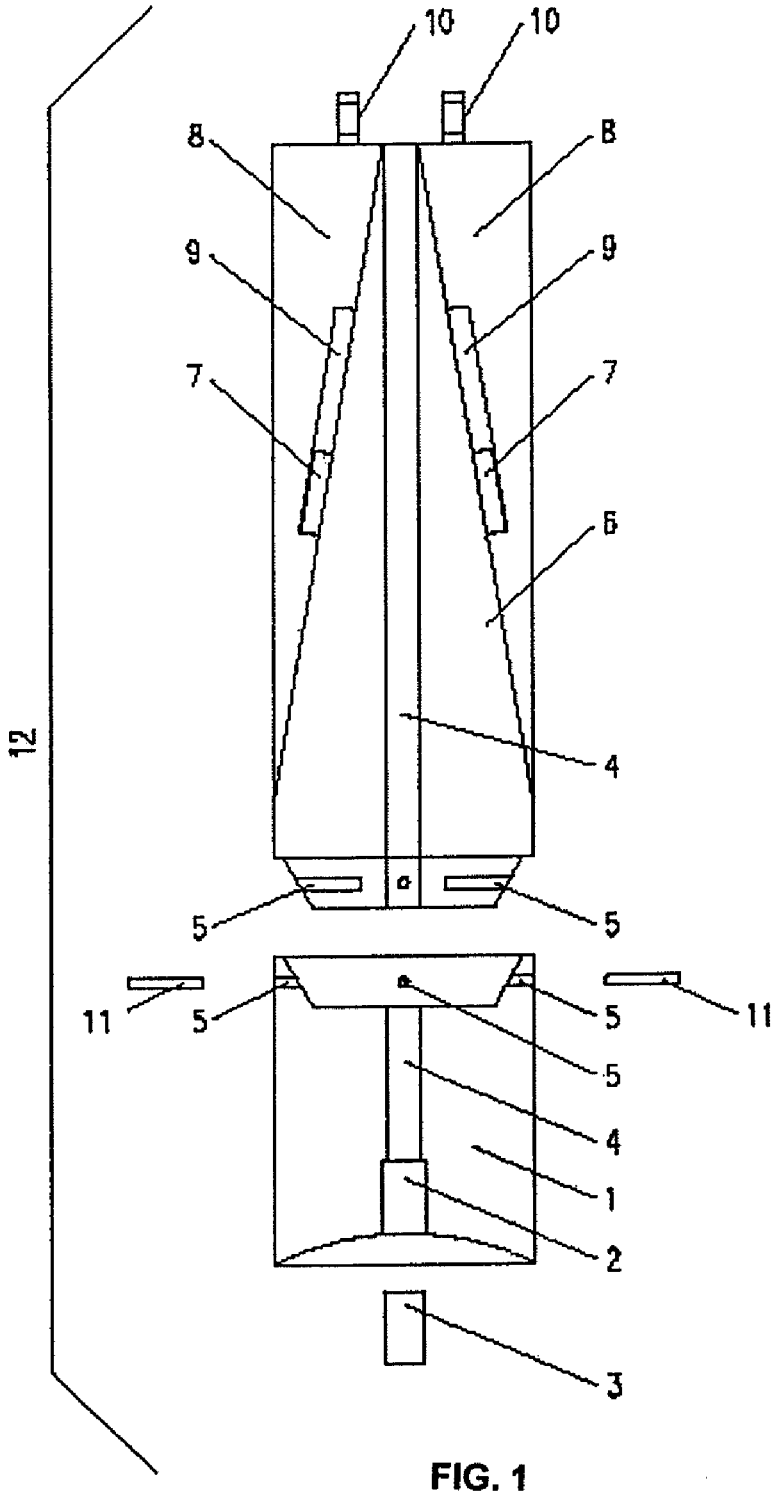
FIG. 1 shows a front cut view of the complete mechanical stemming apparatus according to the invention before being assembled and used in a blasting operation.
Figure 2:
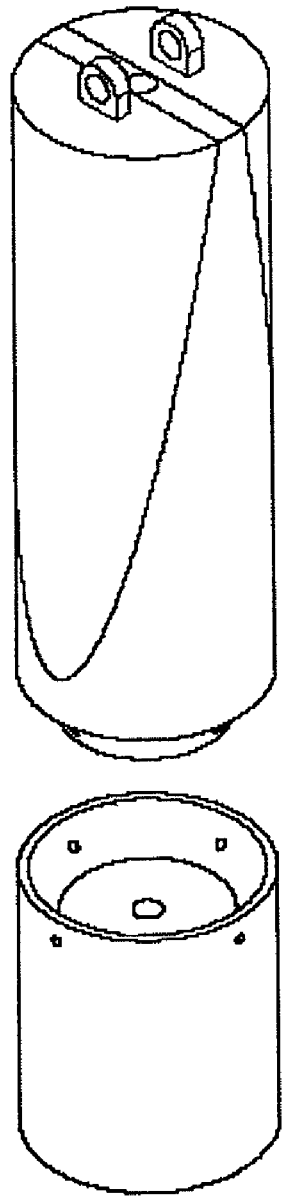
FIG. 2 shows an isometric view of the complete mechanical stemming apparatus according to the invention before being assembled and used in a blasting operation.
Figure 9:
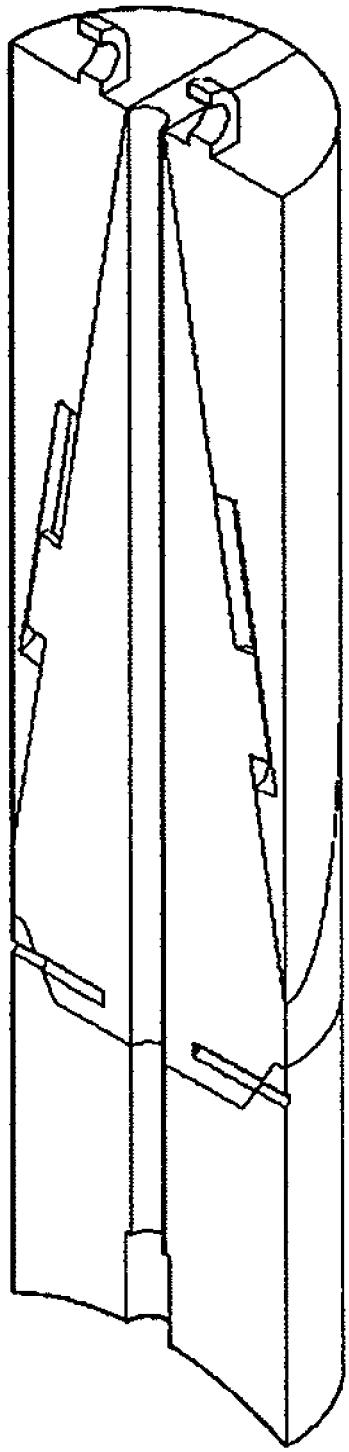
FIG. 9 shows an isometric cut view of the mechanical stemming apparatus according to the present invention.

FIGS. 1 and 2 show the different pieces of the mechanical stemming apparatus according to the invention, and FIG. 9 shows a cut view of said apparatus to clarify the following detailed description.

Figure 3:
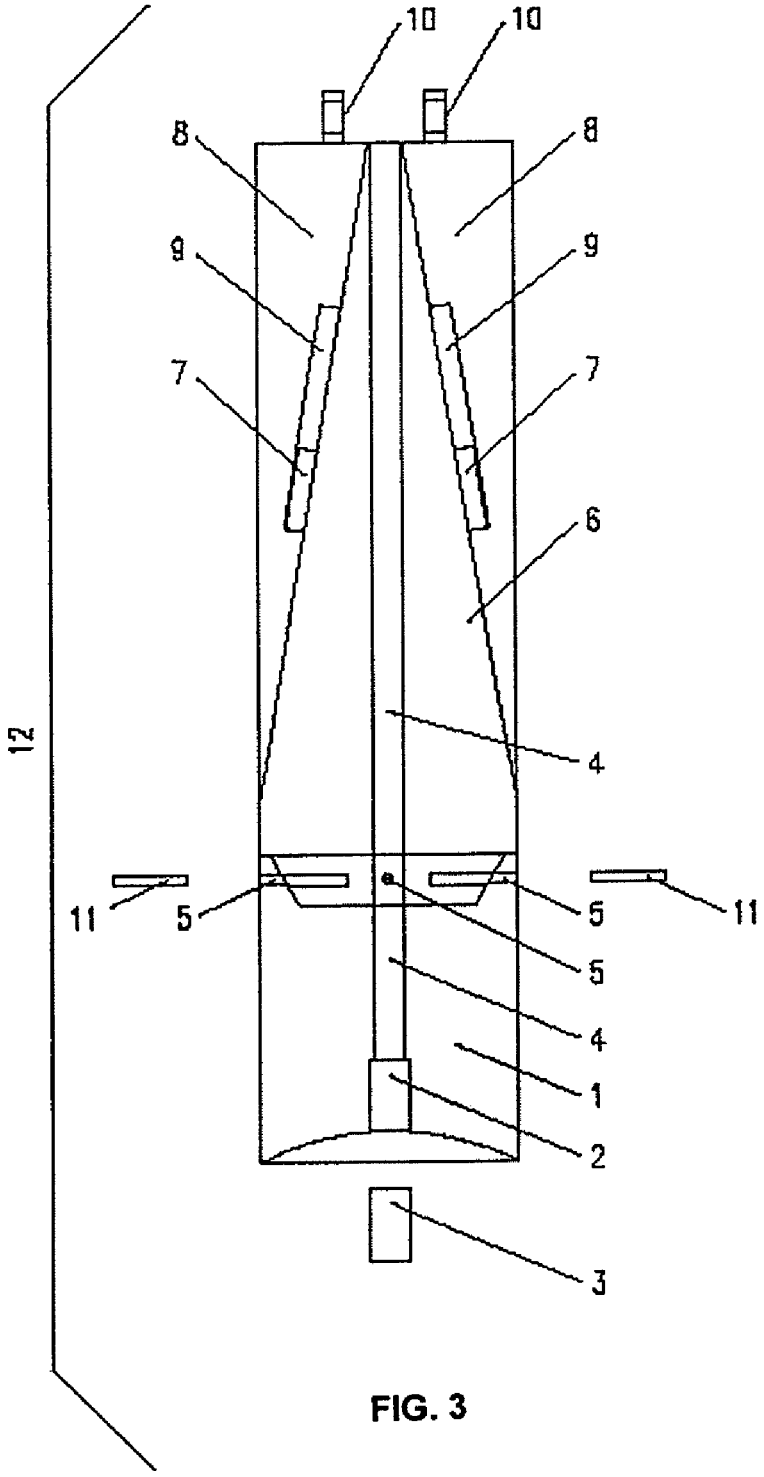
FIG. 3 shows a front cut view of the assembled mechanical stemming apparatus according to the invention before being used in a blasting operation.
Figure 4:
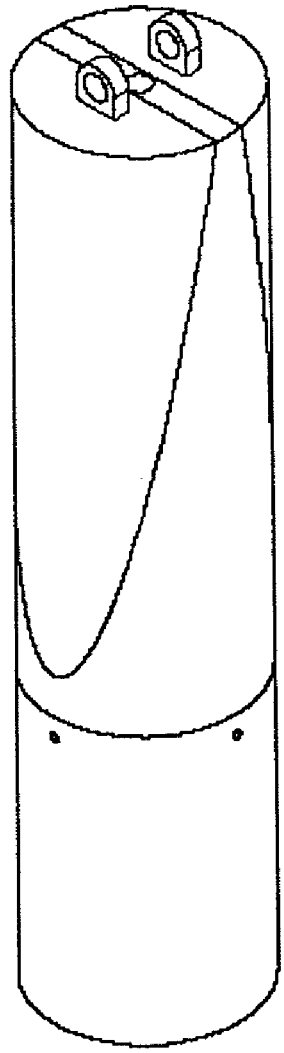
FIG. 4 shows an isometric view of the assembled mechanical stemming apparatus according to the invention before being used in a blasting operation.

As shown in FIGS. 3 and 4, a mechanical stemming apparatus for mining blasting operations assembled according to the present invention comprises 2 pieces, placed one over the other:

a. a base piece (1) and
b. a central piece (6), and
c. additionally includes two lateral wedge pieces (8) and four supporting pivots (11).

The entire mechanical stemming apparatus set according to the present invention, forms a main cylindrical body (12) with a diameter lower than the borehole diameter and a length directly proportional to the diameter and depth of the boreholes or blast holes. The base piece (1) of the main body (12) is formed by a cylindrical body, with a diameter lower that the borehole diameter, ranging from 101.6 mm (4") to 787.4 mm (31") and more, being the most frequent application range in open-pit mining from 152 mm (6") to 349.25 mm (13¾"), said base piece having a cavity at its bottom end and a female coupling cone at its top end with four circular perforations (5) wherein supporting pivots (11) will be introduced (not shown in the Figures) to connect the central piece (6), having a central circular perforation (4) from one end to the other through which electric lines pass, the form of which will depend on the type and diameter of the electric lines used by each mining company in blasting operations; ranging said central circular perforation (4) from 6.35 mm (¼") to 30 mm (1⅕"), optionally including a broader section (2) with a higher diameter at the bottom end of the base piece (1). Said base piece (1) will be subjected to high pressures and temperature. Therefore, it will be made from the abovementioned raw materials, with a richer mixture in its composition, such as for example, polymer mixtures in general and mixtures of polymers with siliceous sands, aluminosilicates, chromite, magnesia, quartz, zircon, refractory synthetic sands, and other sands, and also concretes and refractory mortars in general, as well as mixtures with refractory cements, Portland cement, alternative cements, biocements, etc., with the purpose of giving more strength against pressure and temperature effects when blasting occurs.

Optionally, a plug (3) made from the abovementioned same materials of the base piece (1) is included, also including a central circular perforation (not shown in the Figures) from one end to the other with a diameter that is lower than the diameter of the central circular perforation (4), and a slot (not shown in the Figures) from the center to the edge and from one end to the other through which electric lines pass.

The central piece (6) that operates simultaneously with the lateral wedge pieces (8) in the first and second moment of the stemming of the borehole or blast hole, is formed by a cylindrical-base cone that has a cylindrical shape at its bottom end with a diameter lower than the diameter of the perforation, which ranges from 101.6 mm (4") to 787.4 mm (31") and more, ranging the most frequent application in open-pit mining from 152 mm (6") to 349.25 mm (13¾"), said cylindrical base also having at its bottom end a male coupling cone with four circular perforations (5) where supporting pivots (11) will be introduced to connect the base piece (1), having said central piece a cylindrical shape at its top end with two angular cuts and the two remaining sides maintaining their curvature, also having a central circular perforation (4) from one end to the other through which electric lines pass, the shape of said perforation depending on the type and diameter of the electrical lines used by each mining company in blasting operations; ranging said central circular perforation (4) from 6.35 mm (¼") to 30 mm (1⅕"). Furthermore, in each angular cut at said top end male guides (7) are vertically placed in the central part, thus allowing the central piece (6) to slide against the lateral wedge pieces (8).

The vertical angular cuts from one end to the other of said central piece (6) range from 175° to 164°, preferably from 174° to 168° and more preferably from 173° to 170°.

The lateral wedge pieces (8) that operate simultaneously with the central piece (6) in the first and second moment of the borehole or blast hole stemming, are formed by vertical angular cuts from one end to the other at its inner sides and maintain their curvature at their entire outer sides. Their top ends are flat, while the bottom ends are point-shaped, and furthermore they have female guide grooves (9) placed vertically at both angular cuts on the central part, next to its ends, where male guides (7) are introduced outside in the angular cuts of the central piece (6), which are vertically placed on the central piece, next to its ends, thus allowing the lateral wedge pieces (8) to slide against the central piece (6). Furthermore, at the top (flat) ends of the lateral wedge pieces (8) rings (10) made from the same material from which the mechanical stemming apparatus is made are inserted, through which a rope or string will pass, said rope or string allowing the mechanical stemming apparatus to be moved inside the borehole or blast hole according to the present invention.

The vertical angular cuts from one end to the other of said inner sides of said lateral wedge pieces (8) range from 5° to 16°, preferably from 6° to 12° and more preferably from 7° to 10°.

The group comprising the abovementioned pieces will form a single body, which will be the main body of the mechanical stemming apparatus (12).

Figure 5:
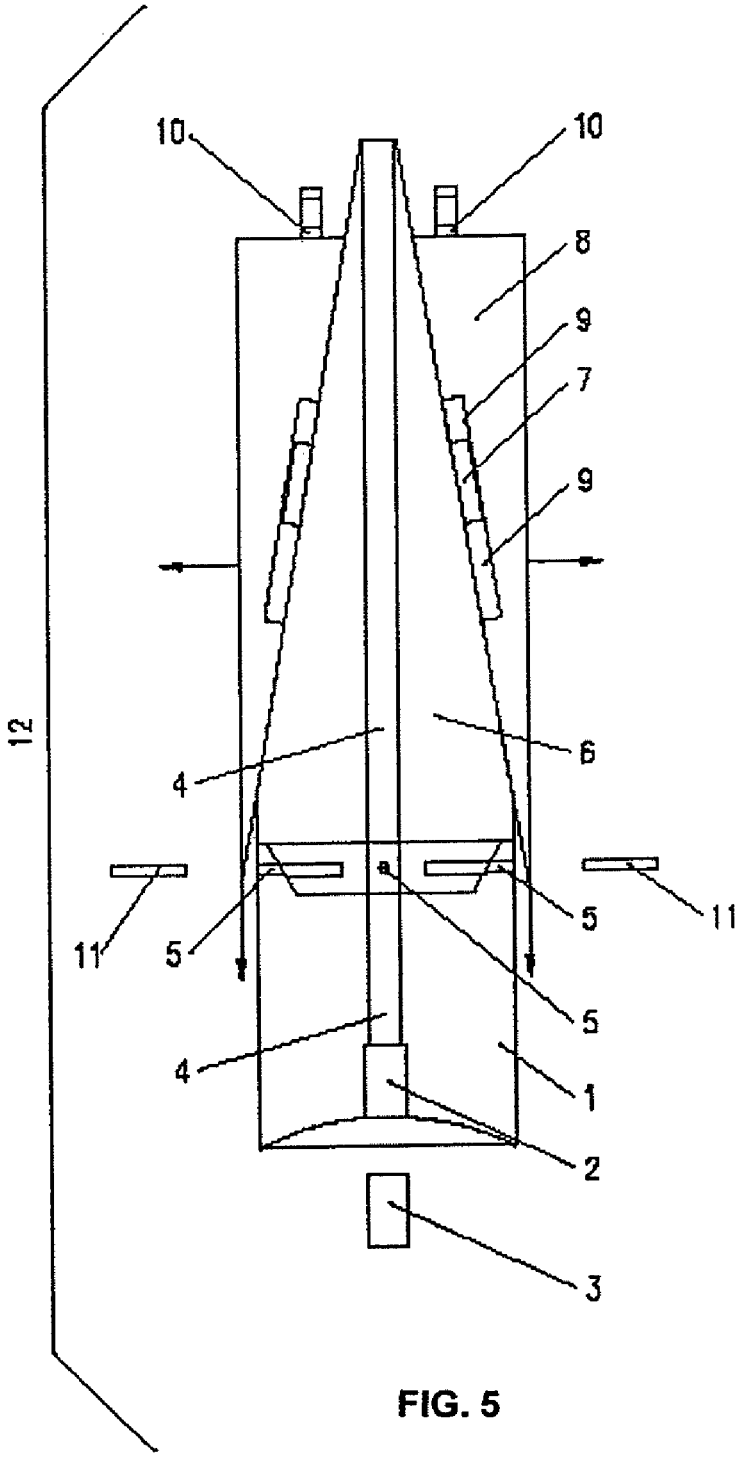
FIG. 5 shows a front cut view of the mechanical stemming apparatus in a first stemming moment defined below inside a borehole or blast hole.
Figure 6:
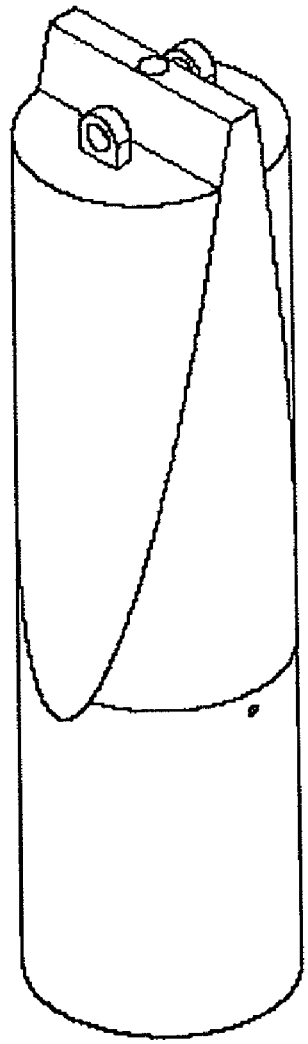
FIG. 6 shows an isometric view of the mechanical stemming apparatus in a first stemming moment inside a borehole or blast hole.

Once the explosive charge is set in the borehole or blast hole, the base piece (1) is assembled with the central piece (6) as shown in FIGS. 3 and 4. Then, the main body (12) of the mechanical stemming apparatus, comprising the base piece (1), the central piece (6) and the two lateral wedge pieces (8) is set to introduce the electric line coming from a detonator placed at the explosive charge through the central circular perforation (4) passing from one end of the base piece (1) and the central piece (6) to the other. Afterwards, a rope or string is introduced through the rings (10) placed at the top flat ends of the lateral wedge pieces (8). Then, the main body (12) of the mechanical stemming apparatus is introduced inside the borehole or blast hole, holding and slightly tensing the electric lines from the mouth or collar of the borehole or blast hole, and slowly sliding said main body downward through the rope or string, which are removed by pulling one of its ends when direct contact with the detritus (isolating) material is achieved. Immediately after this action, as indicated by arrows in FIG. 5, the lateral wedge pieces (8) are lowered from the central piece (6) by sliding through the guides (male and female) and said lateral wedge pieces remaining fixed and in direct contact with the borehole or blast hole walls, thereby producing the first mechanical stemming moment depicted in FIGS. 5 and 6. For this effect, a minimal lapse of time is used for installation of the mechanical stemming apparatus in comparison with current borehole or blast hole stemming techniques.

Figure 7:
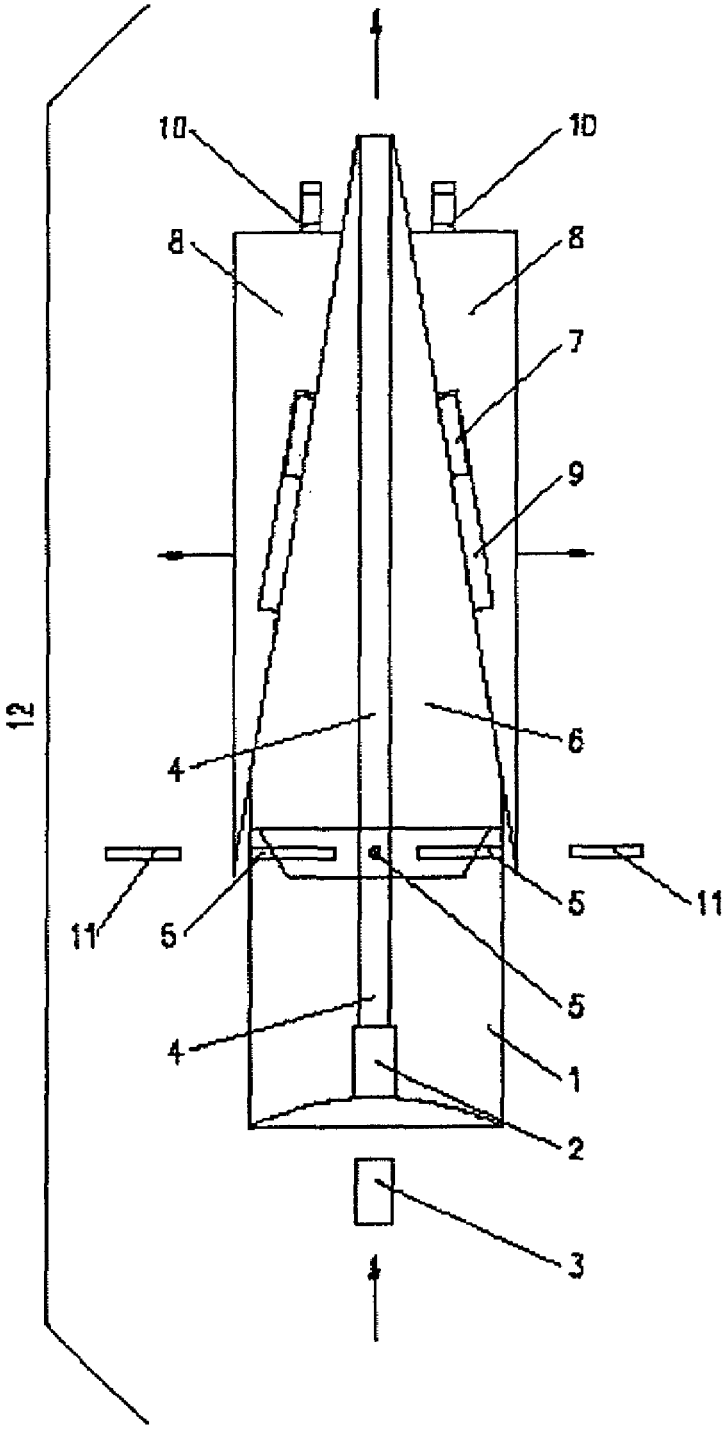
FIG. 7 shows a front cut view of the mechanical stemming apparatus in a second stemming moment defined below inside a borehole or blast hole.
Figure 8:
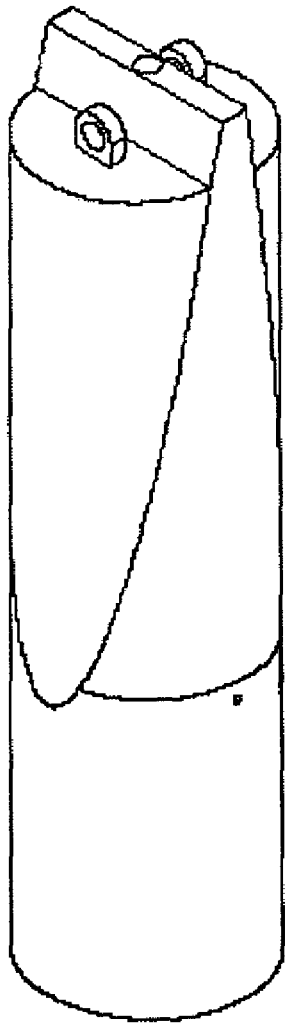
FIG. 8 shows an isometric view of the mechanical stemming apparatus in a second stemming moment inside a borehole or blast hole.

The second mechanical stemming moment depicted in FIGS. 7 and 8 is produced by the detonation operation and a correct confinement of the gases generated by explosives, which violently move up the base piece (1) already connected to the central piece (6), without moving the lateral wedge pieces (8) from their position, and this action allows the central piece to press the lateral wedge pieces (8) against the borehole or blast hole walls, as indicated by arrows in FIG. 7. Likewise, the lateral wedge pieces (8) are pressed against the central piece (6), thus preventing the central piece (6) to continue its ascending displacement, thus causing a total mechanical stemming of the borehole or blast hole at that moment.

The advantages of the apparatus of the present invention include the following:

- minimal installation time for the mechanical stemming apparatus;
- no need of personnel for manual stemming of those boreholes or blast holes that present difficulties;
- no need of mini-loaders and bobcats and their respective operators;
- minimal amount of soil material, cuttings or detritus as isolating material between the explosive column and the mechanical stemming device;
- decrease of the number of bore operations in the firing grid, maintaining the same current grid surface, since the use of the mechanical stemming apparatus allows widening the spacing distance;
- decrease of the amount of explosive due to the improvement in efficiency caused by the confinement of the explosive;
- the generated shock waves have the expected intensity, obtaining in this way enough energy propagation in rock fragmentation;
- by applying the mechanical stemming system, a better fragmentation control on the rock to be extracted is obtained, thus defining new protocols for: redesign of the firing grid, explosive type, profile and load factor, thus yielding an improvement in rock fragmentation quality;
- flatter floor levels;
- lower amount of man-hours in comparison with current stemming techniques for boreholes or blast holes;
- lower amount of machine-hours in comparison with current stemming techniques for boreholes or blast holes;
- higher material extraction speed due to better rock fragmentation;
- lower rock projections toward space or toward neighboring labors to blasting operations;
- lower boulder generation in blasting operations, thus avoiding higher costs related to secondary firings (boulder reduction) which usually cause operational loading problems;
- longer useful life of shovel buckets by avoiding strong impacts produced by boulder displacement;
- longer useful life of hoppers in trucks for transport of mineral and sterile materials or ballast, thus avoiding strong impacts and abrasion caused by large boulders, both in loading and unloading operations;
- longer useful life in primary crushers due to crushing of lump ore with lower size;
- longer useful life of grinding equipment due to grinding a much higher percentage of fine material, produced by a better rock fragmentation;
- fuel and electricity economy; and
- protection and care of the environment due to more silent blasting operations, thus avoiding acoustic contamination issues and suspended powders that affect the different working areas, workers and general community.

By applying the mechanical stemming apparatus, a better development will be produced in mining blasting processes, incorporating benefits in operational, cost and productivity terms in the great mining industry.

The invention claimed is:

1. A mechanical stemming apparatus for mining blasting operations to contain or confine gases generated by explosives, thus preventing generated energy from being released to the atmosphere, wherein the mechanical stemming apparatus comprises two main pieces, one over the other:

a) a base piece (1) and b) a central piece (6), the central piece additionally comprises two lateral wedge elements (8) and four supporting pins (11);

wherein the base piece (1) is formed by a cylindrical body with a smaller diameter than the diameter of a borehole or blast hole into which the apparatus is inserted, the cylindrical body having a cavity at its bottom end and a coupling female cone at its top end with four circular perforations (5) to introduce said supporting pins (11) to connect the central piece (6) and a central circular perforation (4) from the top end of the cylindrical body to the bottom end of the cylindrical body, through which electric lines can pass.

2. The mechanical stemming apparatus according to claim 1 wherein the central circular perforation (4) ranges from 6.35 mm (¼") to 30 mm (1⅕").

3. The mechanical stemming apparatus according to claim 2, wherein the base piece (1) includes a broader section (2) having a diameter that is larger than the diameter of the central circular perforation (4).

4. The mechanical stemming apparatus according to claim 3, wherein the apparatus includes a plug (3), the apparatus having a central circular perforation extending from a first end of the apparatus to a second opposite end of the apparatus, the plug having a diameter that is smaller than the diameter of the central circular perforation (4), the apparatus further comprising a slot from its center to its circumference and from its first end to its second opposite end through which electric lines can pass.

5. A mechanical stemming apparatus for mining blasting operations to contain or confine gases generated by explosives, thus preventing generated energy from being released to the atmosphere, wherein the mechanical stemming apparatus comprises two main pieces, one over the other: p1 a) a base piece (1) and b) a central piece (6), the central piece additionally comprises two lateral wedge elements (8) and four supporting pins (11);

wherein the central piece (6) is formed by a cylindrical body with a diameter that is smaller than the diameter of a borehole or blast hole into which the apparatus is to be inserted, the apparatus further having a male coupling cone at its bottom end, the male coupling cone defining four circular perforations (5) to allow the introduction of supporting pins (11) to connect the base piece (1), the cylindrical body adopting a beveled cylindrical shape at its top end, with two angular cuts, and maintaining its curvature on its remaining sides, the apparatus further having a central circular perforation (4) from a first end to a second opposite end through which electric lines can pass, the apparatus further comprising male guides (7) vertically located at both angular cuts at the top end of the central piece, thus allowing the central piece (6) to slide against lateral wedge pieces (8).

6. The mechanical stemming apparatus according to claim 5 wherein the central circular perforation (4) ranges in size from 6.35 mm (¼") to 30 mm (1⅕").

7. The mechanical stemming apparatus according to claim 5 wherein the vertical angular cuts from one end of the beveled edges of the central piece (6) to the other range from 175° to 164°.

8. The mechanical stemming apparatus according to claim 7 wherein the angular cuts range preferably from 174° to 168°.

9. The mechanical stemming apparatus according to claim 8 wherein the angular cuts range preferably from 173° to 170°.

10. A mechanical stemming apparatus for mining blasting operations to contain or confine gases generated by explosives, thus preventing generated energy from being released to the atmosphere, wherein the mechanical stemming apparatus comprises two main pieces, one over the other:

a) a base piece (1) and b) a central piece (6), the central piece additionally comprises two lateral wedge elements (8) and four supporting pins (11);

wherein the two lateral wedge pieces (8), that act simultaneously with the central piece (6) in the first and second moments of the mechanical stemming, are formed by making vertical angular cuts in the central piece (6) from its first end to its second opposite end at its inner sides and maintain the curvature of the central piece circumference, the top end of the central piece as cut being flat while the bottom end being point-shaped, and further forming female guide grooves (9) at both angular cuts, the female guide grooves being vertically located at the central piece, adjacent to the ends, where male guides (7) are introduced, which male guides (7) are externally located at the angular cuts of the central piece (6) and are vertically arranged at the central part, next to their ends, thus allowing the lateral wedge pieces (8) to slide against the central piece (6).

11. The mechanical stemming apparatus according to claim 10 wherein the vertical angular cuts from one end of the inner sides of the lateral wedge pieces (8) to the other range from 5° to 16°.

12. The mechanical stemming apparatus according to claim 11 wherein the angular cuts range preferably from 6° to 12°.

13. The mechanical stemming apparatus according to claim 12 wherein the angular cuts range preferably from 7° to 10°.

* * * * *